United States Patent [19]

Van der Heijde

[11] Patent Number: 4,535,313

[45] Date of Patent: Aug. 13, 1985

[54] ELECTROMAGNETIC DEFLECTION UNIT AND COLOR DISPLAY TUBE PROVIDED WITH SUCH A UNIT

[75] Inventor: Martin C. Van der Heijde, Eindhoven, Netherlands

[73] Assignee: U.S. Philips Corporation, New York, N.Y.

[21] Appl. No.: 651,964

[22] Filed: Sep. 18, 1984

[30] Foreign Application Priority Data

Sep. 21, 1983 [NL] Netherlands ..... 8303238

[51] Int. Cl.[3] ..... H01F 1/00

[52] U.S. Cl. ..... 335/212; 335/210; 313/431

[58] Field of Search ..... 335/210, 212, 213; 313/421, 426, 429, 430, 431

[56] References Cited

U.S. PATENT DOCUMENTS 3,191,104 6/1965 Mak ..... 335/210
4,231,009 10/1980 Barkow ..... 335/210 X
4,242,612 12/1980 Heijnemans et al. ..... 335/210 X
4,396,897 8/1983 Sluijterman et al. ..... 335/210 X

FOREIGN PATENT DOCUMENTS 56-68082 6/1981 Japan ..... 335/212

*Primary Examiner*—George Harris
*Attorney, Agent, or Firm*—Thomas A. Briody; William J. Streeter

[57] ABSTRACT

An electromagnetic deflection unit has a conical coil holder with a flange which carries coils for the horizontal deflection of electron beams. The coils have segments extending substantially in the longitudinal direction of the coil holder and near these segments are arranged soft-magnetic members on the inwardly directed side of the coils in order to influence the magnetic field of these coils and hence to reduce convergence errors. The soft-magnetic members are incorporated, in a configuration suitable for the relevant type of deflection unit, in a moulded annular body of synthetic material.

6 Claims, 3 Drawing Figures

ELECTROMAGNETIC DEFLECTION UNIT AND COLOR DISPLAY TUBE PROVIDED WITH SUCH A UNIT

BACKGROUND OF THE INVENTION

1. Field of the Invention

The invention relates to an electromagnetic deflection unit for a colour display tube comprising a conical coil holder which carries a set of coils for the horizontal deflection of electron beams, which coils have segments which extend substantially in the longitudinal direction of the coil holder, soft-magnetic members being arranged on the inwardly facing side of said coils in the proximity of the said segments. The invention further relates to a colour display tube provided with such a deflection unit.

Such a deflection unit and a colour display tube provided with such a unit are commercially available.

2. Description of the Prior Art

Current techniques of winding deflection coils are not sufficiently good to manufacture coils having such a distribution of turns that all the requirements with respect to convergence and raster are satisfied simultaneously. The known unit comprises a plurality of soft-magnetic members which influence the magnetic field of the set of coils producing the horizontal deflection and thus reduce residual convergence errors in the corners of the display screen. In contrast therewith, geometrical (raster) errors are corrected, if required, by means of permanent magnets which are mounted outside the coils on the side of the coil holder to be directed towards the display screen.

The number, the shape and the size of the members as well as their position with respect to the set of coils for horizontal deflection have to satisfy stringent requirements in any type of deflection unit. However, these requirements are the same for units of a given type. The soft-magnetic members therefore are not intended to be used for neutralizing any differences in the properties of the units of one type, but for correcting the residual errors with regard to the convergence in the design of a type of deflection unit.

The step of arranging and fixing the members, which may be of different shape and size, in the correct position is time-consuming and hence expensive, the more so as a comparatively large number, for example, four, six or eight members may be concerned. In order to be able to produce a maximum field strength with a minimum of power, the coils for horizontal deflection are generally located within the coil holder so that—when the deflection unit is mounted on a display tube—the coils are arranged as close as possible to the display tube. This construction of a deflection unit results in that the members generally have to be adhered for the major part to the inner surface of the coils. The fairly uneven surface of the coils can, however, lead to a poor adherence, as a result of which members become detached. It is usual to position the soft-magnetic members by means of adhesive tape and to fix them by means of an adhesive.

SUMMARY OF THE INVENTION

The invention has for its object to provide an electromagnetic deflection unit having a construction which permits a rapid and simple mounting of such members.

The invention provides an electromagnetic deflection unit of the kind described in the opening paragraph in which the soft-magnetic members are incorporated in an annular body of synthetic material.

When for a given type of deflection unit the number, the shape, the size and the position of the members are determined, for example, empirically and the members are incorporated in an annular body with the correct geometrical arrangement only one component part for these members need be provided during the assembly of such a deflection unit. Moreover, due to the conical shape of the coil holder, the annular body is generally automatically in the correct position in the longitudinal direction of the coil holder when the annular body abuts against the coils, against the coil holder or against both the coil holder and the coils.

In one embodiment, the annular body has on its outer side facing the coil holder means for locking the annular against rotation from its correct position. The annular body may have a groove or a slot which co-operates with a projection on the coil holder. Another possibility consists in that recesses are provided for receiving those segments of the coils which extend substantially in the longitudinal direction of the coil holder. This has the advantage that the annular body need not be secured to the coil holder. As soon as a display tube is provided within the deflection unit, the annular body is in fact also fixed in the longitudinal direction of the coil holder.

In a further embodiment, the annular body may be secured to the coil holder. This facilitates the manipulation of the unit. This securing step may be effected, for example, by means of an adhesive. An annular body with recesses for the coil segments as mentioned in the preceding paragraph has the advantage that the step of fixing the annular body can be effected by adhering the body directly at the coil holder between the coil segments. In a variation, the annular body and the coil holder have cooperating means which keep the annular body fixed to the coil holder.

In the last-mentioned variation, for example, resilient tongues may co-operate with projections. Thus, U-shaped openings may be formed in the annular body, which results in that a resilient tongue is obtained, and the coil holder may have projections which, when the annular body has been mounted, are located in these openings and behind which the resilient tongues engage.

Thermoplastic materials may advantageously be used for the annular body. The synthetic material may be provided around the soft-magnetic members or these members may be provided in openings recessed to this end in the annular body. The soft-magnetic members may be composed of a mixture of synthetic material, for example the same synthetic material of which the annular body consists, and soft-magnetic powder. The annular body itself and the soft-magnetic members therein can be moulded in one mould.

The annular body may have a very thin wall of the order of 1 mm. Since the body is a substitute for separately arranged members having a similar thickness, the use of the annular body does not or substantially not entail an increase of the distance of the deflection coils from a colour display tube arranged within the deflection unit.

A favourable property of such annular bodies is that they can keep the members curved according to the curvature of the coil segments at the area at which the soft-magnetic members are situated.

It should be noted that from U.S. Pat. No. 3,191,104 there is known a deflection unit for a monochrome display tube, in which the deflection coil system is surrounded by a hood of synthetic material which carries permanent magnets for correcting raster errors. The hood of synthetic material has at its one wide end a heavy continuous edge, in which permanently magnetizable material is dispersely incorporated. Dependent upon the required raster correction, larger or smaller regions per individual deflection unit are permanently mangnetized by means of an electromagnet in order to form in situ magnet bodies having the thickness of this edge.

Embodiments of the deflection unit and colour display tube combination according to the invention will now be described by way of example with reference to the accompanying drawings.

DESCRIPTION OF THE PREFERRED EMBODIMENTS

Figure 1:
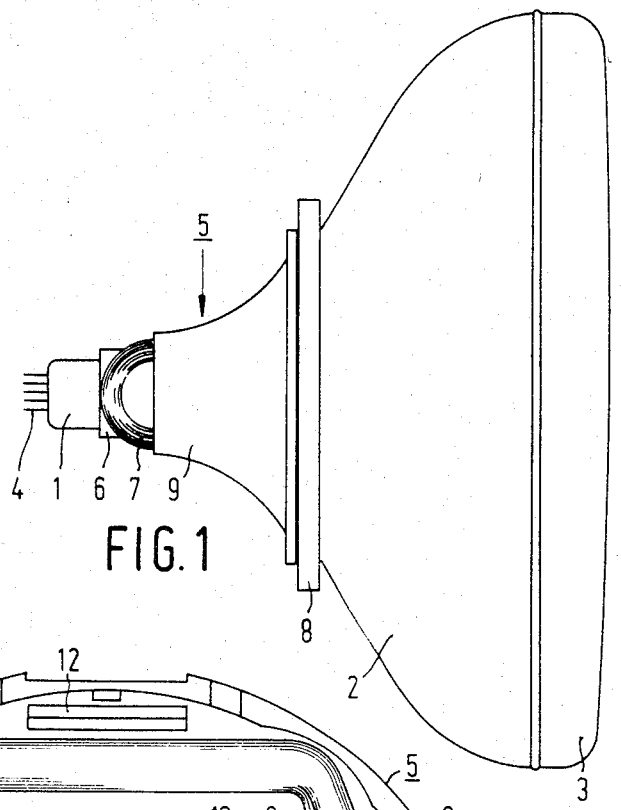
FIG. 1 is a side elevation of a colour display tube.

The colour display tube shown in FIG. 1 has a neck 1, a cone 2, and a picture screen 3. Connecting pins 4 emanate from the neck 1. A deflection unit 5 is arranged to surround the neck 1 and to engage the cone 2. The deflection unit has a conical coil holder 6 of synthetic material, for example of polystyrene/polyphenylene oxide, which carries deflection coils of the saddle type. One deflection coil 7 for vertical deflection of electron beams is visible. A conical ring 9 of soft-magnetic material, for example nickel-zinc-ferrite or manganese-zinc-ferrite, is arranged to surround the coils and co-operates with them. The ring 9 is secured to a flange 8 of the coil holder 6, which flange is situated at the wide end of the coil holder facing the screen 3.

Figure 2:
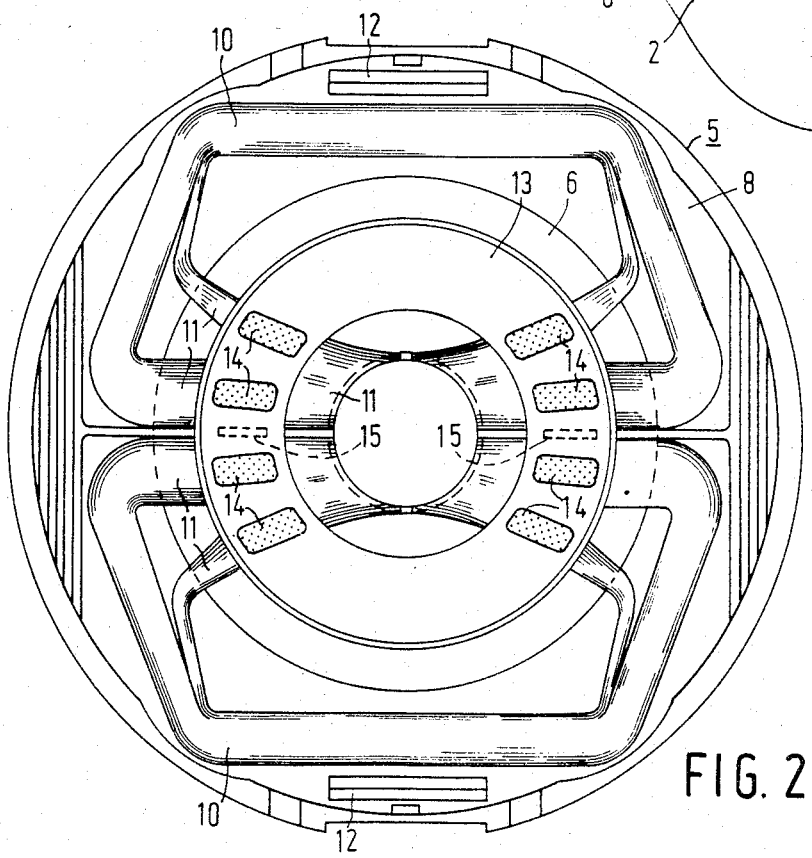
FIG. 2 shows a deflection unit, viewed from the wide end of the coil holder.

In FIG. 2, the deflection unit 5 has the conical coil holder 6 which is provided with the flange 8. Coils 10 of the saddle type for horizontal deflection of electron beams are carried by the coil holder 6. The coils 10 have segments 11 which extend substantially in the longitudinal direction of the coil holder 6. The flange 8 at the wide end of the coil holder 6 carries besides the coils 10 permanent magnets 12 for the correction of raster errors. The deflection unit 5 has in addition an annular body 13 of conical form made from synthetic material, in which soft-magnetic members 14 are incorporated. The members 14 are situated on the inwardly directed side of the coils 10 adjacent the segments 11. In the unit shown, the body 13 consists of polyphenylene oxide/-polystyrene and it has a wall thickness of 1 mm; the soft-magnetic members are moulded from mixture of 60% by volume of polyphenylene oxide/polystyrene and 40% by volume of manganese-zinc ferrite. The annular body 13 and the members 14 were formed in one mould.

At its outer surface the annular body 13 has shaped protrusions 15, which each engage between two adjacent segments 11 and lock the body 13 against rotation.

The annular body 13 carries the soft-magnetic members 14 required for the unit 5 in the correct number, the correct shape, the correct size and the correct geometry. When the body 13 is brought into its desired position within the conical coil holder 6, the members 14 are provided as one unitary piece in one operation. The conical form of the coil holder then defines the position of the annular body 13 in the longitudinal direction of the coil holder 6, while the protrusions 15 at the outer surface of the body 13 prevents rotation of the latter.

Figure 3:
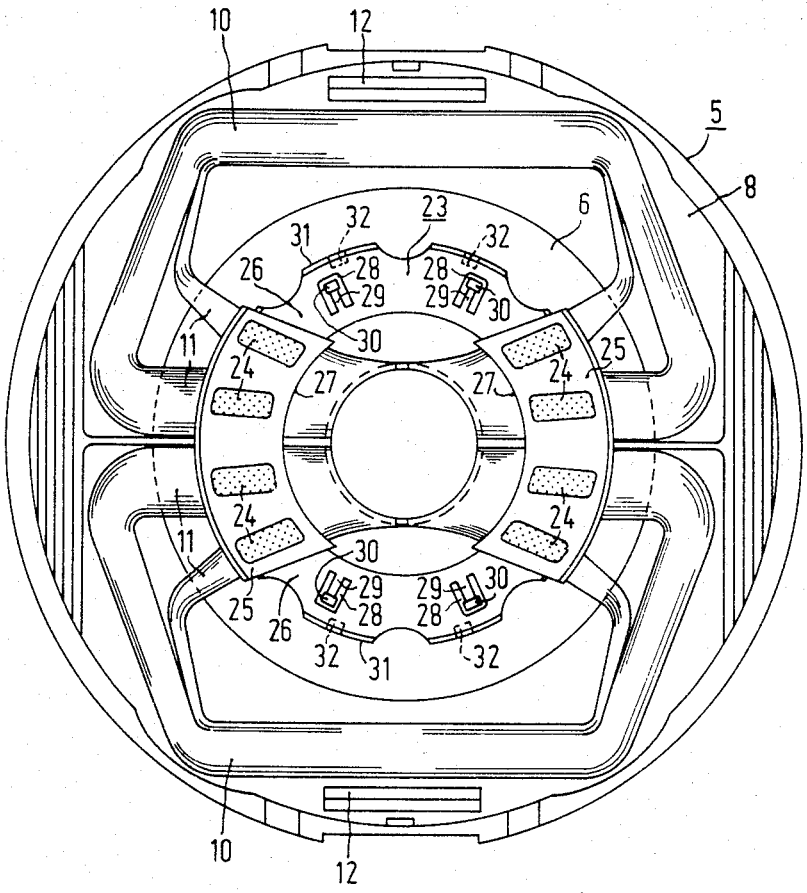
FIG. 3 shows a variation of the deflection unit of FIG. 2, observed from the same view-point.

In FIG. 3, like reference numerals designate like parts present in FIG. 2. In FIG. 3, an annular body 23 also of conical form made from synthetic material, in which soft-magnetic members 24 are incorporated, is provided with the members 24 being located in similar positions as with the annular body 13 in FIG. 2. The parts 26 of the annular body 23 are displaced outwards i.e. away from the longitudinal axis with respect to the parts 25. As a result, the annular body 23 has on its outer side a profile with recesses 27 which lock the body against rotation because the segments 11 are engaged therein.

The body 23 could be fixed in the coil holder 6 by securing it by means of an adhesive to the coil holder at its parts 26 engaging the coil holder. In the drawing, however, the body 23 has U-shaped openings 28 each of which defines a respective resilient tongue 29. The coil holder 6 protrusions 30 each of which projects into a respective opening 28 and behind which a respective tongue 29 engates. The body 23 is fixed in the coil holder 6 by the co-operating tongues 29 and protrusions 30.

In a variation, the required fixing is obtained by causing protrusions formed on the coil holder 6 to engage around the edge 31 of the body 23, for example, into recesses 32.

What is claimed is:

1. An electromagnetic deflection unit for a color display tube comprising a conical coil holder which carries a set of coils for the horizontal deflection of electron beams, said coils having segments which extend substantially in the longitudinal direction of the coil holder, soft-magnetic members being arranged on the inwardly facing side of said coils in the proximity of the said segments, said soft-magnetic members being incorporated in an annular body of synthetic material.

2. An electromagnetic deflection unit as claimed in claim 1 wherein said annular body on its outer side facing the coil holder has means for locking the annular body against rotation.

3. An electromagnetic deflection unit as claimed in claim 2 wherein said annular body is provided on its outer side with recesses in which are located the said segments of the coils for horizontal deflection.

4. An electromagnetic deflection unit as claimed in claim 2 wherein the said coil holder and the annular body have co-operating means which keep the annular body secured within the coil holder.

5. An electromagnetic deflection unit as claimed in claim 3 wherein said coil holder and said annular body have co-operating means which keep the annular body secured within the coil holder.

6. In combination, a color display tube and an electromagnetic deflection therefor, said deflection unit comprising a conical coil holder which carries a set of coils for the horizontal deflection of electron beams, said coils having segments which extend substantially in the longitudinal direction of the coil holder, soft-magnetic members being arranged on the inwardly facing side of said coils in the proximity of the said segments, said soft-magnetic members being incorporated in an annular body of synthetic material.

* * * * *